US009732494B2

(12) United States Patent
Honda et al.

(10) Patent No.: US 9,732,494 B2
(45) Date of Patent: Aug. 15, 2017

(54) BUCKET AND WORKING VEHICLE PROVIDED WITH THE SAME

(71) Applicant: KOMATSU LTD., Minato-ku, Tokyo (JP)

(72) Inventors: Toshimitsu Honda, Hitachinaka (JP); Toshiyuki Ohta, Hitachinaka (JP); Minoru Wada, Mooka (JP); Katsuhiro Tsutsumi, Hitachinaka (JP); Takaya Kobayashi, Hitachinaka (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 0 days.

(21) Appl. No.: 14/894,098

(22) PCT Filed: Jul. 15, 2015

(86) PCT No.: PCT/JP2015/070324

§ 371 (c)(1),
(2) Date: Nov. 25, 2015

(87) PCT Pub. No.: WO2015/167025

PCT Pub. Date: Nov. 5, 2015

(65) Prior Publication Data

US 2017/0016203 A1 Jan. 19, 2017

(51) Int. Cl.
*E02F 3/40* (2006.01)

(52) U.S. Cl.
CPC ..... *E02F 3/40* (2013.01)

(58) Field of Classification Search
CPC ..... E02F 3/40
(Continued)

(56) References Cited

U.S. PATENT DOCUMENTS 4,081,919 A * 4/1978 Teach ..... E02F 3/40 37/444
4,791,737 A 12/1988 Morelli
(Continued)

FOREIGN PATENT DOCUMENTS

CN 101336324 12/2008
CN 201687022 U 12/2010
(Continued)

OTHER PUBLICATIONS

Office Action in corresponding Japanese Application No. JP 2015-552933, issued Jun. 28, 2016, 12 pages, with English translation.
(Continued)

*Primary Examiner* — Gary Hartmann
(74) *Attorney, Agent, or Firm* — Fish & Richardson P.C.

(57) ABSTRACT

A bucket with a linear lower front edge includes: a first straight portion horizontally extending from the lower front edge toward an innermost of the bucket; an inclined portion continuous with a rear edge of the first straight portion, the inclined portion further extending toward the innermost of the bucket while being inclined upward; a curve continuous with a rear edge of the inclined portion at a lower edge of the curve, the curve having a predetermined bucket radius; a second straight portion continuous with an upper edge of the curve, the second straight portion being inclined upward toward a bucket opening; and a third straight portion bent at a bent portion toward the bucket opening relative to a front edge of the second straight portion, the third straight portion further extending toward the bucket opening.

8 Claims, 5 Drawing Sheets

(58) Field of Classification Search
USPC ..... 37/444
See application file for complete search history.

(56) References Cited

U.S. PATENT DOCUMENTS

| | | | | |
|---|---|---|---|---|
| 5,992,062 | A * | 11/1999 | Evans | E02F 9/2833 37/444 |
| 6,581,308 | B1 | 6/2003 | Woerman et al. | |
| 8,015,734 | B1 | 9/2011 | Mills et al. | |
| 8,201,350 | B2 * | 6/2012 | Folkerts | E02F 9/2825 37/379 |
| 8,851,826 | B2 * | 10/2014 | Nagata | E02F 3/40 414/722 |
| 9,139,975 | B2 * | 9/2015 | Rochel | E02F 3/40 |
| 9,447,561 | B2 * | 9/2016 | Nitti | E02F 3/40 |
| 2009/0003984 | A1 | 1/2009 | Osanai et al. | |
| 2011/0289803 | A1 | 12/2011 | Folkerts et al. | |
| 2012/0301258 | A1 | 11/2012 | Nagata et al. | |
| 2013/0067779 | A1 | 3/2013 | Mills et al. | |
| 2015/0032644 | A1 * | 1/2015 | Zeno | E02F 3/40 705/307 |

FOREIGN PATENT DOCUMENTS

| | | |
|---|---|---|
| CN | 102041821 | 5/2011 |
| CN | 102906342 | 1/2013 |
| CN | 102947511 | 2/2013 |
| JP | S57-060950 | 4/1982 |
| JP | 2000-129714 | 5/2000 |
| JP | 2007-186929 A | 7/2007 |
| JP | H04-117046 U | 7/2008 |
| JP | 2013-526664 A | 6/2013 |
| WO | WO 2011-049061 A1 | 4/2011 |

OTHER PUBLICATIONS

Office Action in Japanese Application No. JP 2015-552933, dispatched Feb. 23, 2016, including English translation, 11 pages.
International Search Report dated Aug. 18, 2015 from corresponding International Application No. PCT/JP2015/070324, including English translation, 4 pages.
Kuniaki Nakada et al., Komatsu Technical Report, vol. 51, No. 156, Komatsu Ltd., "Research and Development of Low-noise Bucket for Construction Machine", Feb. 28, 2006.
Hiroshi Sunada, Komatsu Technical Report, vol. 50, No. 153, Komatsu Ltd., "Development of Wear-resistant Bucket (e-Bucket) for PC200 Series", Dec. 1, 2004.
Extended European Search Report in European Application No. 15785285.6, dated Dec. 23, 2016, 9 pages.
Hiroshi Sunada, Komatsu Technical Report, vol. 50, No. 153, Komatsu Ltd., "Development of Wear-resistant Bucket ( e-Bucket) for PC200 Series", Dec. 1, 2004, full English translation.
Office Action in Chinese Application No. 201580001095.1, dated May 4, 2017, 8 pages, with English translation.

* cited by examiner

BUCKET AND WORKING VEHICLE PROVIDED WITH THE SAME

CROSS-REFERENCE TO RELATED APPLICATIONS

This application claims priority to International Application No. PCT/JP2015/070324 filed on Jul. 15, 2015, the contents of which are incorporated herein by reference in their entirety.

TECHNICAL FIELD

The present invention relates to a bucket and a working vehicle provided with the same.

BACKGROUND ART

A typical working vehicle such as a wheel loader is provided with working equipment including a bucket. When seen in a cross sectional view, a known bucket includes: a middle portion curved in an arc with a predetermined bucket radius; a bottom linearly extending from a lower side of the middle portion in a tangent direction of the arc; and a top linearly extending from an upper side of the middle portion in the tangent direction of the arc (see, for instance, Patent Literature 1).

CITATION LIST

Patent Literature(s)

Patent Literature 1: JP-A-2013-526664

SUMMARY OF THE INVENTION

Problem(s) to be Solved by the Invention

Such a typical bucket, however, entails a problem in a shoveling work or an excavation work on a heap of earth, ground or the like depending on the type, size (diameter) or the like of an object. Specifically, an object pushed and remaining in the middle portion deep inside the bucket blocks the following object from entering the bucket, which results in prevention of a smooth shoveling work and thus in failure in ensuring workload (productivity).

Accordingly, to solve the above problem, the bucket may have a larger bucket radius at the deep inside thereof in a cross sectional view to increase a deep-side bucket capacity.

However, such a simple increase in the bucket capacity leads to interference of the bucket with a portion therebehind (i.e., a boom adjacent to the bucket at a vehicle-rear side) when the wheel loader is in a traveling position. An increase in the capacity is thus limited. When the position of the bucket is shifted forward to prevent the interference, a reduction in a bucket depth is inevitable, and thus the capacity cannot be increased.

As long as a sufficient workload is ensured, an excavation distance may be increased. However, the bucket is then required to be stably thrust forward over the entire increased excavation distance, which is another problem to be solved.

An object of the invention is to provide a bucket capable of ensuring workload and stably performing a shoveling work and an excavation work, and a working vehicle provided with the bucket.

Means for Solving the Problem(s)

According to an aspect of the invention, a bucket with a linear lower front edge includes: a first straight portion horizontally extending from the lower front edge toward an innermost of the bucket; an inclined portion continuous with a rear edge of the first straight portion, the inclined portion further extending toward the innermost of the bucket while being inclined upward; a curve continuous with a rear edge of the inclined portion at a lower edge of the curve, the curve having a predetermined bucket radius; a second straight portion continuous with an upper edge of the curve, the second straight portion being inclined upward toward a bucket opening; and a third straight portion bent at a bent portion toward the bucket opening relative to a front edge of the second straight portion, the third straight portion further extending toward the bucket opening.

In the above aspect, the curve has a large bucket radius as compared with that of a typical bucket.

The bucket radius of the curve is increased while the inclined portion is provided close to the bucket opening (the front side of the bucket) relative to the curve. Consequently, as the bucket is thrust forward for a shoveling work or an excavation work, an object, which has been pushed into the bucket to reach the curve through the inclined portion, can further slide to rise along the curve at the innermost of the bucket. The object can thus be pushed into the bucket more and more without being blocked.

Further, the curve at the innermost of the bucket is defined at a high level by the presence of the inclined portion near the bucket opening relative to the curve. Consequently, although a bucket capacity is reduced at a lower portion of the bucket in spite of the large bucket radius, an upper portion of the bucket, i.e., a bulging portion defined by the second and third straight portions and the bent portion, can compensate for this reduction. The bucket capacity can thus be ensured without the necessity of upwardly changing a dimension of the bucket opening, and the object can further smoothly enter the bucket through the upper portion of the bucket opening by the presence of the curve having the large bucket radius.

As described above, when the curve has the large bucket radius, the object can be smoothly pushed toward the innermost of the bucket, thereby utilizing an inherent bucket capacity and thus ensuring a sufficient workload.

Further, the bucket, which is provided with the first straight portion near the bucket opening, can be thrust into the object horizontally straight forward for a shoveling work or an excavation work, thereby stably performing the shoveling work or the excavation work.

It should be noted that the curve at the innermost of the bucket is defined above the first straight portion and the inclined portion not to project rearward even though the bucket radius is increased, so that the bucket is prevented from interfering with the boom or the like even in a traveling position.

In the above aspect, it is preferable that the first straight portion includes a plate-shaped attachment portion defining the lower front edge and a plate-shaped bottom continuous with a rear edge of the plate-shaped attachment portion, or consisting of the plate-shaped attachment portion.

In the above aspect, it is preferable that an angle between the inclined portion and the first straight portion is four degrees or more.

In the above aspect, it is preferable that a ratio of a horizontal length of the first straight portion to a horizontal length from the lower front edge to a most-projecting position of the curve toward the innermost of the bucket is in a range from 0.3 to 0.5.

In the above aspect, it is preferable that an upper exterior surface of the bucket is provided with a reinforcing member for reinforcing the upper exterior surface, and the bent portion is close to the innermost of the bucket relative to the reinforcing member.

According to another aspect of the invention, a working vehicle includes the bucket.

In the above aspect, it is preferable that the working vehicle further includes: a vehicle body frame; and a boom that connects the bucket and the vehicle body frame, in which a distance between the bucket and the boom is minimized at the bent portion when the wheel loader is in a traveling position.

BRIEF DESCRIPTION OF DRAWING(S)

DESCRIPTION OF EMBODIMENT(S)

An exemplary embodiment of the invention will be described below with reference to the attached drawings.

Figure 1:
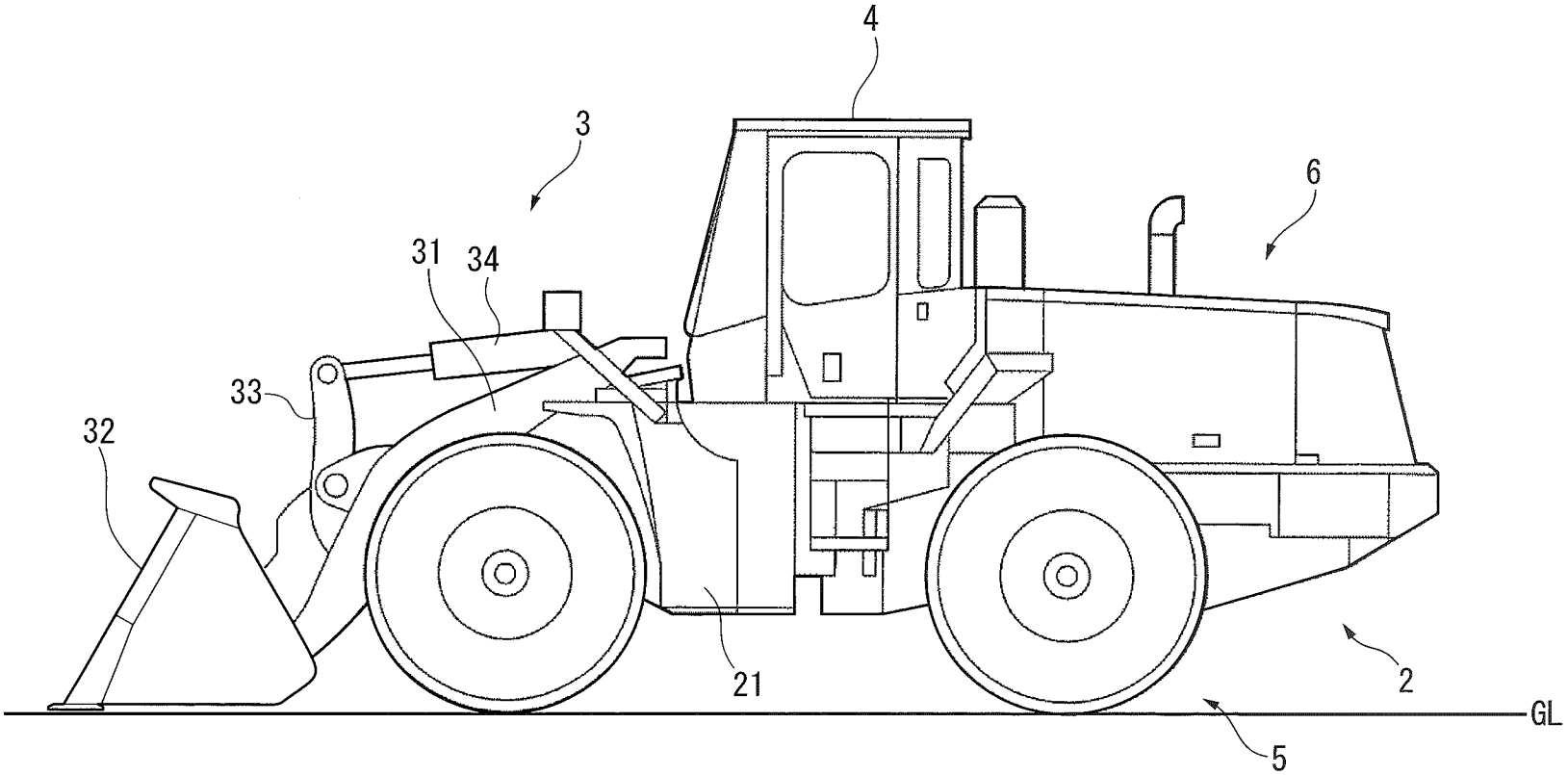
FIG. 1 is a side view showing a working vehicle according to an exemplary embodiment of the invention.

FIG. 1 is a side view showing a wheel loader 1 (working vehicle) according to the exemplary embodiment. It should be noted that, in the figures, directions are determined with reference to an operator in an operating state for the wheel loader 1. Specifically, a vehicle front-rear direction is simply referred to as a front-rear direction, a vehicle width direction is referred to as a right-left direction, and a vehicle up-down (vertical) direction is simply referred to as an up-down (vertical) direction. Further, an innermost of the bucket means a rear side relative to a bucket opening.

Description of Overall Arrangement of Wheel Loader

As shown in FIG. 1, the wheel loader 1 includes a steel vehicle body 2. The vehicle body 2 includes a rear vehicle body frame and a steel front vehicle body frame 21, which is a vehicle body frame swingable in the right-left direction relative to the rear vehicle body frame. The rear vehicle body frame is provided with a cab 4, a traveling unit 5 and a power output section 6. Working equipment 3 is supported at a front side of the front vehicle body frame 21.

The working equipment 3 is described in detail. The working equipment 3 includes a boom 31 pivotally supported by the front vehicle body frame 21, a bucket 32 vertically pivotally supported by the boom 31, and a bell crank 33 pivotally supported by the boom 31 at a middle of the boom 31.

The boom 31, which includes right and left pair of booms, is pivotally supported to be vertically swingable relative to the front vehicle body frame 21. A lift cylinder (not shown) is supported at the middle of the boom 31, the lift cylinder having a base end portion pivotally supported by the front vehicle body frame 21. A hydraulic extension and retraction of the lift cylinder causes the boom 31 to be vertically swung.

The bucket 32 is to be loaded with an object W (FIG. 3) such as excavated soil. The bucket 32 has a link (not shown) that is pivotally supported above a position where the bucket 32 is pivotally supported by the boom 31. The opposite end of the link is pivotally supported at a lower end of the bell crank 33.

The bell crank 33, which is pivotally supported between the pair of booms 31, has the lower end connected to a base end portion of the link. A bucket cylinder 34 is pivotally supported at an upper end of the bell crank 33. A base end portion of the bucket cylinder 34 is pivotally supported by the front vehicle body frame 21.

Figure 3:
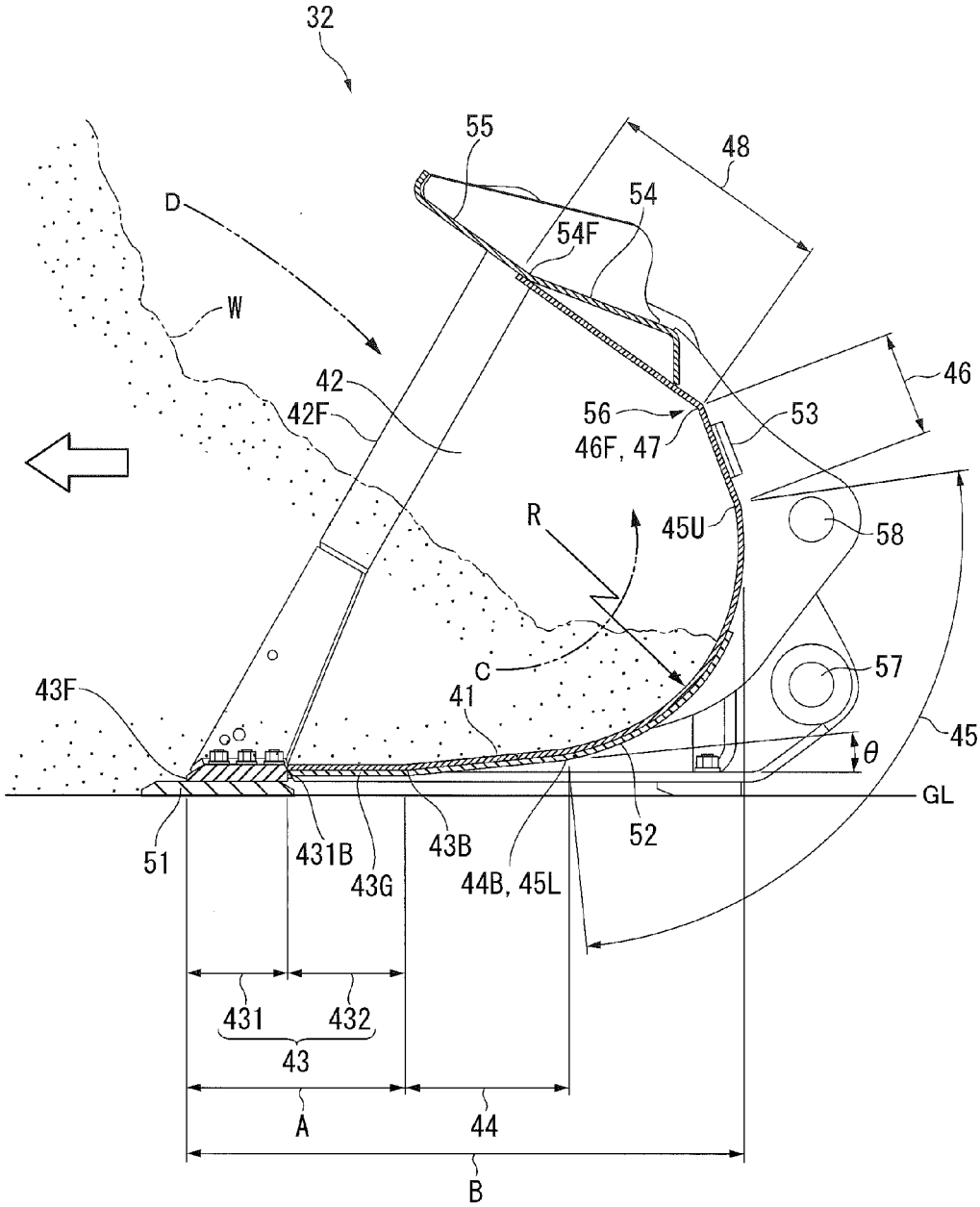
FIG. 3 is a cross sectional view showing the bucket.

The bucket 32 is positioned to be slightly in contact with a ground surface GL and thrust into a pile of blasted rocks or a ground (a white arrow in FIG. 3 shows a thrusting direction). When the lift cylinder is extended, the boom 31 is swung upward with the bucket 32 being loaded with the object W (FIG. 3) to perform the shoveling work or the excavation work.

Further, when the bucket cylinder 34 is retracted with the bucket 32 being positioned above, an upper end portion of the bell crank 33 is rotated toward the vehicle body 2, while a lower end portion thereof is rotated toward a vehicle front side. The link then pushes an upper portion of the bucket 32 toward the vehicle front side, thereby rotating the bucket 32 to dump the object W loaded in the bucket 32.

Specific Description of Bucket

Figure 2:
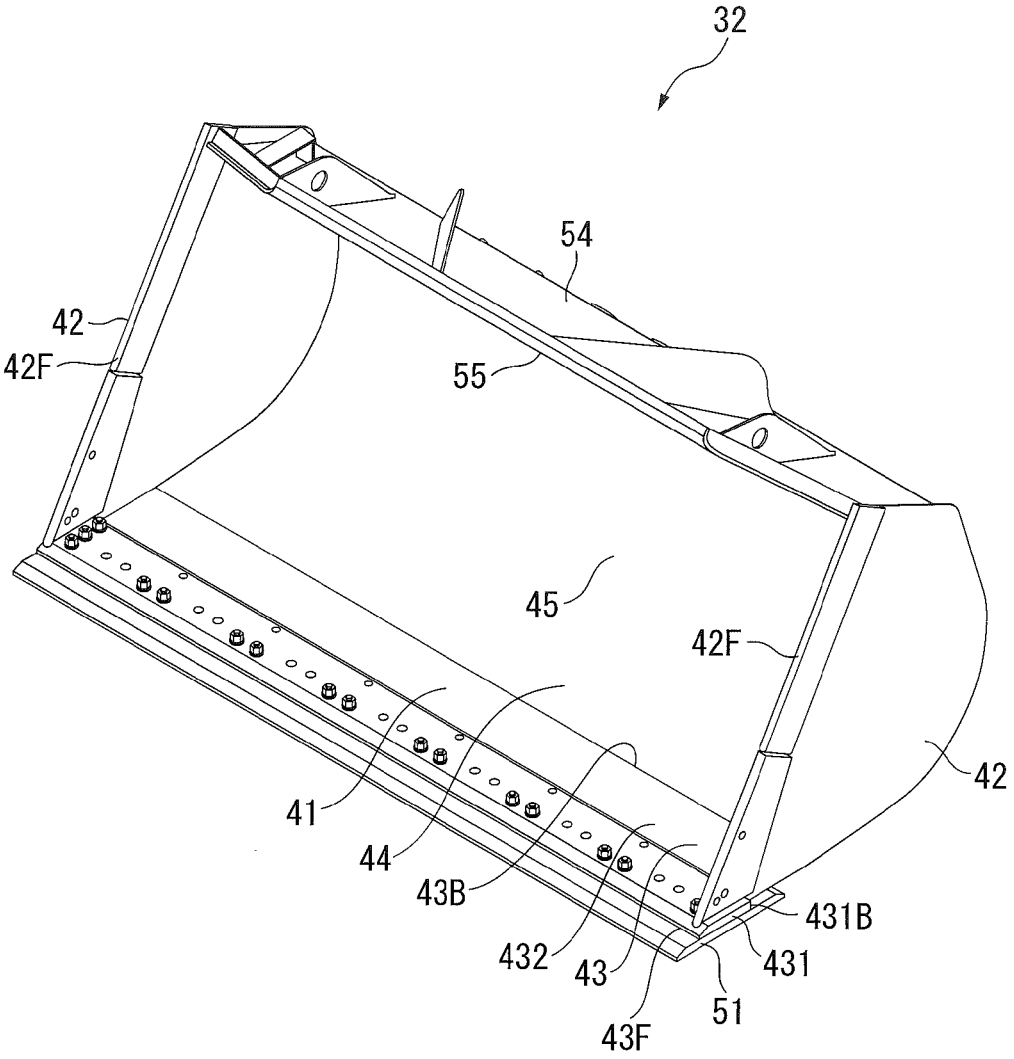
FIG. 2 is a perspective view showing the entirety of a bucket provided to the working vehicle.

FIG. 2 is a perspective view showing the entirety of the bucket 32. FIG. 3 is a sectional view showing a side of the bucket 32 with a bottom 43G being set horizontal.

As shown in FIGS. 2 and 3, the bucket 32, a lower front edge 43F of which is in the form of a linear flat blade, includes a main plate 41 continuous from a lower side to an upper side of the bucket opening, and a pair of side plates 42 covering right and left sides of the main plate 41. A lower portion of each of the side plates 42 may be attached with a side edge guard (not shown).

The main plate 41 includes: a first straight portion 43 horizontally extending from the lower front edge 43F toward the innermost of the bucket; a flat inclined portion 44 continuously further extending from a rear edge 43B of the first straight portion 43 toward the innermost of the bucket while being inclined upward toward the innermost of the bucket; a curve 45 with a predetermined bucket radius R having a lower edge 45L continuous with a rear edge 44B of the inclined portion 44; a second straight portion 46 continuous with an upper edge 45U of the curve 45 and inclined upward toward the bucket opening; and a third straight portion 48 bent at a bent portion 47 toward the bucket opening relative to a front edge 46F of the second straight portion 46 and further extending toward the bucket opening.

The first straight portion 43 includes a plate-shaped attachment portion 431 including the lower front edge 43F and a plate-shaped bottom 432 continuous with a rear edge 431B of the plate-shaped attachment portion 431, and defines the bottom 43G. The plate-shaped attachment portion 431, which is a thick steel plate elongated along the right-left direction, has a lower surface to which a bottom guard 51 is bolted. The plate-shaped bottom 432, the inclined portion 44, the curve 45, the second straight portion 46, the bent portion 47 and the third straight portion 48 are made of a single steel plate, and a laminated plate 52 is additionally layered over a range from the plate-shaped bottom 432 to a part of the curve 45 to reinforce them.

An angle θ between the inclined portion 44 and the first straight portion 43 (the bottom 43G of the first straight portion 43 in the exemplary embodiment) is four degrees or more, and preferably in a range from four degrees to eight degrees. When the angle is less than four degrees, the object W pushed into the curve 45 from the first straight portion 43 through the inclined portion 44 is unlikely to smoothly slide between the inclined portion 44 and the curve 45 toward the innermost of the bucket. In contrast, when the angle exceeds eight degrees, the bucket 32 is inevitably thrust into the object W with an increased resistance, and thus the operation cannot be smoothly performed. Further, the object pushed into the innermost of the bucket is likely to roll toward the bucket opening.

The bucket radius R of the curve 45 is large as compared with a typical bucket radius. The curve 45 is continuous with the rear side of the inclined portion 44 to be defined at a higher level than that of a typical bucket. The inclined portion 44 provided before the curve 45 is continuous with the curve 45 having the bucket radius R in a tangent direction.

A ratio (A/B) between a horizontal length A of the first straight portion 43 and a horizontal length B from the lower front edge 43F to the most-projecting portion of the curve 45 toward the innermost of the bucket is in a range from 0.3 to 0.5.

For instance, when the ratio falls below 0.3, a height of the inclined portion 44 in the up-down direction is relatively increased. Consequently, the bucket is inevitably thrust into the object W with an increased resistance, and thus the operation cannot be smoothly performed. Further, since the innermost of the bucket is inevitably defined at a higher level, it may be actually difficult to attach the bucket 32 due to interference with the boom 31 or the like. Further, when the ratio falls below 0.3, the horizontal length A of the first straight portion 43 is relatively reduced, and thus the bucket 32 may be unstably thrust into the object W.

In contrast, when the ratio exceeds 0.5, the horizontal length of the curve 45 is relatively reduced, and thus the curve 45 is unlikely to have the large bucket radius R. Further, for instance, the object W cannot be smoothly pushed into the bucket 32, and thus the operation cannot be smoothly performed. When the ratio exceeds 0.5, the length A is also relatively increased, and thus the bucket 32 is inevitably thrust into the object W with an increased resistance.

A stop 53 is provided to a back surface of the second straight portion 46. The stop 53 is a member that is to be deliberately brought into contact with the boom 31 when the wheel loader 1 is in a traveling position (described later). Consequently, the bucket 32, the boom 31, the bell crank 33, and a connecting portion of any other link can be restrained from being rattled during traveling, thereby achieving a noiseless stable traveling.

The bent portion 47, which is defined in an upper exterior surface of the bucket 32, is provided near the innermost of the bucket relative to a reinforcing member 54 for reinforcing a back surface of the third straight portion 48 (i.e., behind the reinforcing member 54). The upper exterior surface of the bucket 32 can thus be reinforced over a wide range not only by the bent portion 47 but also by the reinforcing member 54. The bent portion 47 may be appropriately shaped in the practice of the invention. For instance, the bent portion 47 may be bent with a predetermined bend radius or may be sharply bent to create a right-to-left bend line.

The back surface of the third straight portion 48 is provided with the reinforcing member 54. A spill guard 55 continuously extends from a front edge 54F of the reinforcing member 54 to cover the bucket opening from above It should be noted that the spill guard 55 is not a component of the main plate 41 of the bucket 32 in the exemplary embodiment.

In the exemplary embodiment, the second straight portion 46, the bent portion 47 and the third straight portion 48 in combination define a bulging portion 56 continuous in the right-left direction and bulging outward from the bucket 32. A hollow space defined by the bulging portion 56 accounts for a part of a bucket capacity. In other words, although the bucket capacity is inevitably reduced at a lower side of the bucket 32 when the curve 45 subsequent to the inclined portion 44 is defined at a higher level than that of a typical bucket, the bulging portion 56 compensates for the reduction in the bucket capacity.

Description of Traveling Position

Figure 4:
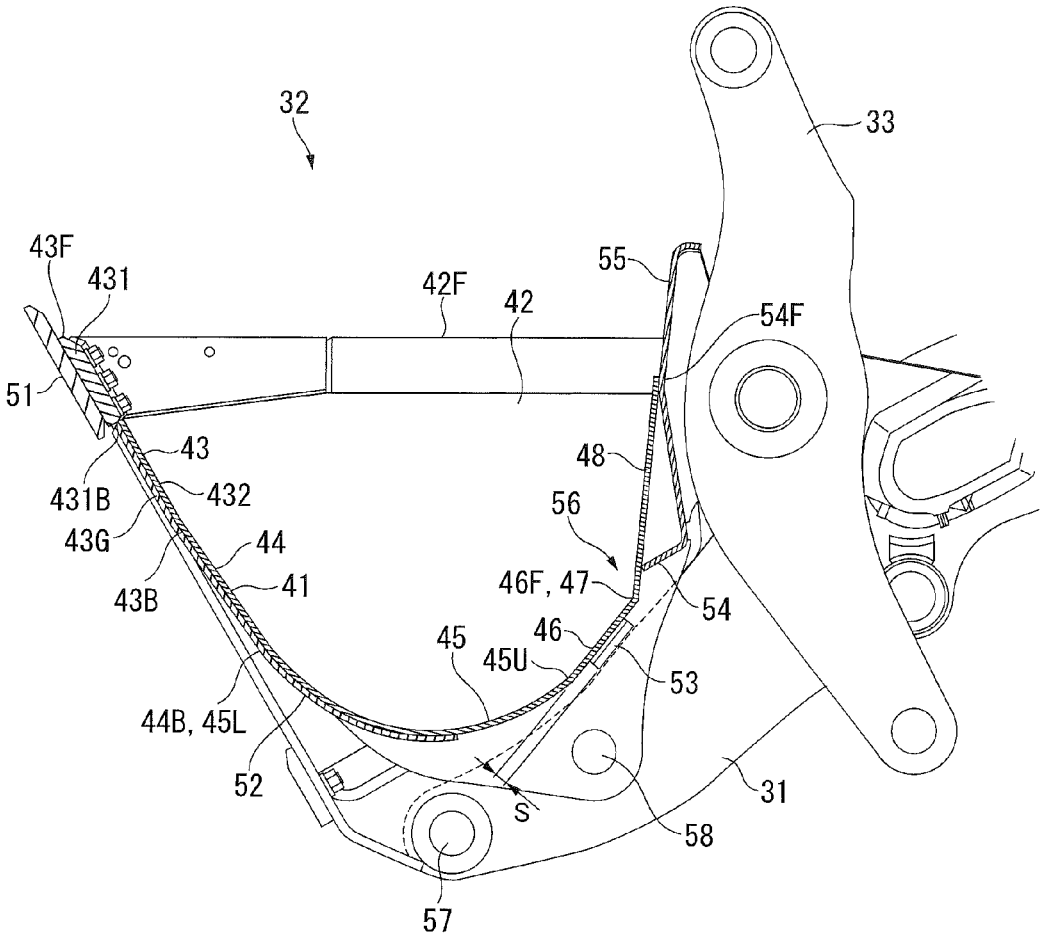
FIG. 4 is a cross sectional view showing a positional relationship between the bucket and a boom in a traveling position.

FIG. 4 shows a positional relationship between the bucket 32 and the boom 31 in the traveling position.

As shown in FIG. 4, in the traveling position, the bucket 32 is tilted at a maximum with the bucket opening facing upward and a front edge 42F of each of the side plates 42 being substantially leveled. In the traveling position, a connecting portion 57 where the bucket 32 is pivotally supported at the end of the boom 31 is lifted above a level of the vehicle body 2 above the ground. In the traveling position, the bucket 32 is brought closest to the boom 31 at the majority of the second straight portion 46 including the bent portion 47 with a distance S therebetween being minimized.

A position of the stop 53 corresponds to the position brought closest to the boom 31. The position of the stop 53 is appropriately determined in view of a moment of the boom 31 that supports the bucket 32 via the stop 53. In the exemplary embodiment, the bucket radius R is maximized until the distance S is minimized as long as the stop 53 is situated at the appropriate position.

The bucket 32 is brought closest to the bell crank 33 at a position corresponding to the third straight portion 48. Accordingly, the shape and dimension of the reinforcing member 54 are appropriately determined so that the reinforcing member 54 can fit in such a narrow space.

It should be noted that, in the figures, a reference numeral 57 seen behind the curve 45 of the bucket 32 denotes the connecting portion between the bucket 32 and the boom 31 as described above, and a reference numeral 58 denotes a connecting portion of a tilt link member (not shown) that connects the lower side of the bell crank 33 and the bucket 32.

Advantage(s) of Exemplary Embodiment(s)

In the exemplary embodiment, the curve 45 of the bucket 32 has a bucket radius larger than a typical one, and the inclined portion 44 is provided close to the bucket opening relative to the curve 45. Consequently, as the bucket 32 is thrust forward for a shoveling work or an excavation work, the object W, which has been pushed into the bucket 32 to reach the curve 45 through the inclined portion 44, can further slide to rise along the curve 45 at the innermost of the bucket as shown by a two-dot chain line and a two-dot chain line arrow C in FIG. 3. The object W can thus be pushed into the bucket 32 more and more without being blocked.

Further, the curve 45 at the innermost of the bucket is defined at a high level by the presence of the inclined portion 44 provided therebefore. Consequently, in the exemplary embodiment, although the bucket capacity is reduced at the lower portion of the bucket in spite of the large bucket radius R, the upper portion of the bucket 32, i.e., the bulging portion 56 defined by the second and third straight portions 46, 48 and the bent portion 47, can compensate for this reduction. Therefore, the large bucket radius R can accelerate, in combination with the bulging portion 56 the movement of the object W into the bucket through the upper portion of the bucket opening as shown by a two-dot chain line arrow D.

An advantage of the large bucket radius R lies not in simply increasing the bucket capacity, but in facilitating the object W to be pushed toward the innermost of the bucket, thereby effectively utilizing the inherent bucket capacity and ensuring a sufficient workload.

Further, the bucket, which is provided with the first straight portion near the bucket opening, can be thrust into the object W horizontally straight forward for a shoveling work or an excavation work, which results in a stable operation.

The bucket 32 of the exemplary embodiment is suitable for the object W that should be smoothly pushed into the curve 45 without sliding or rolling down the inclined portion 44, the object W being crushed to have, for instance, a diameter of approximately 40 mm.

The object W with a large diameter cannot be smoothly pushed into the bucket 32, and thus the wheel loader 1 may get stuck. However, a downward force is generated in the bucket 32 by the presence of the inclined portion 44, and thus a load is applied on the front wheels of the wheel loader 1 to increase a tractive force, thereby facilitating an operation.

Incidentally, it should be understood that the scope of the invention is not limited to the above-described exemplary embodiment(s) but includes any modifications and improvements compatible with the invention.

Figure 5:
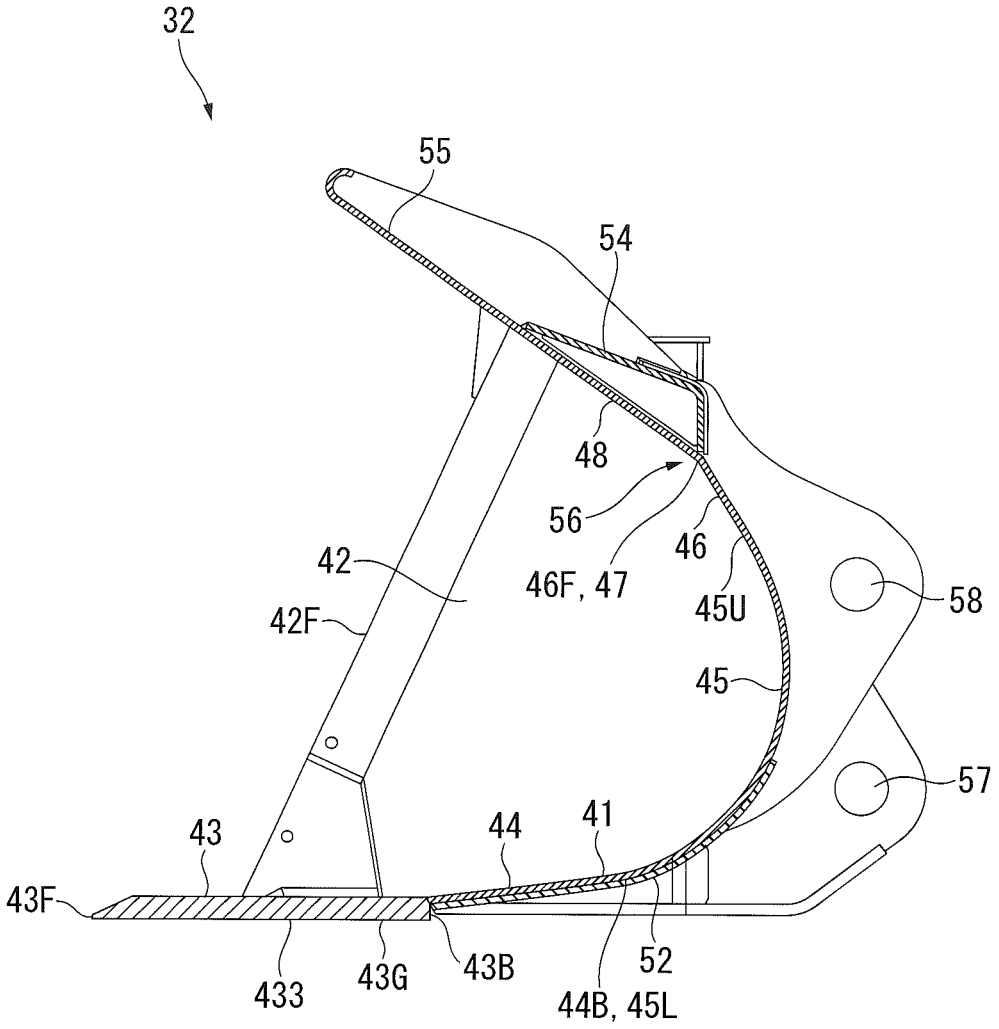
FIG. 5 is a sectional view showing a modification of the invention.

For instance, in the exemplary embodiment, the first straight portion 43 includes the plate-shaped attachment portion 431 having the lower front edge 43F and the plate-shaped bottom 432 subsequent thereto, but the first straight portion 43 may consist solely of a plate-shaped attachment portion 433 entirely made of a single thick steel plate as shown in FIG. 5.

In the exemplary embodiment, the inclined portion 44 is flat, but may be slightly curved (almost flat) according to the invention.

The invention is applicable to not only a wheel loader, but also a backhoe loader, a skid steer loader and the like.

The invention claimed is:

1. A working equipment for a loader, the working equipment comprising:

a bucket; and a boom having a first end pivotally coupled to a vehicle body frame of the loader and a second end pivotally coupled to the bucket, the bucket including:

a linear lower front edge, a first straight portion horizontally extending from the lower front edge toward an innermost of the bucket, an inclined portion continuous with a rear edge of the first straight portion, the inclined portion further extending toward the innermost of the bucket while being inclined upward, a curve continuous with a rear edge of the inclined portion at a lower edge of the curve, the curve having a predetermined bucket radius, a second straight portion continuous with an upper edge of the curve, the second straight portion being inclined upward toward an opening of the bucket, a third straight portion bent at a bent portion toward the opening relative to a front edge of the second straight portion, the third straight portion further extending toward the opening, and a stop positioned at a back surface of the second straight portion, wherein the second straight portion is positioned opposite to the boom to thereby minimize a distance between the bucket and the boom at the bent portion when the bucket is tilted with the opening facing upward, and wherein the stop is positioned opposite to the boom and is configured to be brought into contact with the boom when the bucket is tilted with the opening facing upward.

2. The working equipment according to claim 1, wherein the first straight portion comprises a plate-shaped attachment portion defining the lower front edge and a plate-shaped bottom continuous with a rear edge of the plate-shaped attachment portion.

3. The working equipment according to claim 1, wherein an angle between the inclined portion and the first straight portion is four degrees or more.

4. The working equipment according to claim 1, wherein a ratio of a horizontal length of the first straight portion to a horizontal length from the lower front edge to a most-projecting position of the curve toward the innermost of the bucket is in a range from 0.3 to 0.5.

5. The working equipment according to claim 1, wherein an upper exterior surface of the bucket is provided with a reinforcing member for reinforcing the upper exterior surface, and wherein the bent portion is positioned closer to the innermost of the bucket than it is to the reinforcing member.

6. A loader comprising the working equipment according to claim 1.

7. The working equipment according to claim 1, wherein the position of the stop is determined based on a moment of the boom that supports the bucket via the stop.

8. The working equipment according to claim 1, wherein the first straight portion consists of a plate-shaped attachment portion.

* * * * *